US009478122B2

(12) United States Patent
Hille

(10) Patent No.: US 9,478,122 B2
(45) Date of Patent: Oct. 25, 2016

(54) ELECTROMOTIVE FURNITURE DRIVE ASSEMBLY

(71) Applicant: DEWERTOKIN GMBH, Kirchlengem (DE)

(72) Inventor: Armin Hille, Bielefeld (DE)

(73) Assignee: DEWERTOKIN GMBH, Kirchlengern (DE)

( * ) Notice: Subject to any disclaimer, the term of this patent is extended or adjusted under 35 U.S.C. 154(b) by 0 days.

(21) Appl. No.: 14/407,021

(22) PCT Filed: Jun. 14, 2013

(86) PCT No.: PCT/EP2013/062364
§ 371 (c)(1),
(2) Date: Dec. 10, 2014

(87) PCT Pub. No.: WO2013/186356
PCT Pub. Date: Dec. 19, 2013

(65) Prior Publication Data

US 2015/0130595 A1 May 14, 2015

(30) Foreign Application Priority Data

Jun. 15, 2012 (DE) ..... 10 2012 105 227

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/40* (2013.01); *G08C 2201/42* (2013.01); *G08C 2201/93* (2013.01)

(58) Field of Classification Search
CPC ..... G08C 17/02; G08C 2201/93; G08C 2201/31
USPC ..... 340/12.5; 310/71
See application file for complete search history.

(56) References Cited

U.S. PATENT DOCUMENTS

2004/0051625 A1 3/2004 Nass
2005/0272372 A1 12/2005 Rodriguez (Continued)

FOREIGN PATENT DOCUMENTS

| | | |
|---|---|---|
| DE | 41 23 206 | 1/1993 |
| DE | 197 048 054 | 5/1999 |
| DE | 199 34 981 | 2/2001 |
| DE | 102 30 476 | 1/2004 |
| DE | 20 2010 012 910 | 4/2012 |

OTHER PUBLICATIONS

International Search Report issued by the European Patent Office in International Application PCT/EP2013/062364 on Jun. 14, 2013.

*Primary Examiner* — Allen T Cao
(74) *Attorney, Agent, or Firm* — Henry M. Feiereisen LLC

(57) ABSTRACT

A motorized furniture drive assembly (10) comprises at least one motorized furniture drive (3); at least one drive control device having a receiving device for wireless radio transmission; and at least one communication device (4) for operating the furniture drive (3). The motorized furniture drive assembly (10) is provided with at least one communication adaptation device (5), which is designed to communicate with the at least one communication device (4) by means of a primary wireless transmission path and to communicate with the at least one receiving device by means of a secondary wireless transmission path. An assembly comprises the motorized furniture drive assembly (10) and a piece of furniture (1).

16 Claims, 3 Drawing Sheets

(56) References Cited

U.S. PATENT DOCUMENTS

2011/0205061 A1 8/2011 Wilson
2012/0138067 A1* 6/2012 Rawls-Meehan .... A47C 20/041 128/845
2012/0194106 A1 8/2012 Hille
2012/0206070 A1 8/2012 Hille
2013/0300233 A1* 11/2013 Loley ..... A61G 7/018 310/71
2015/0007393 A1* 1/2015 Palashewski ..... A47C 27/10 5/713

* cited by examiner

ELECTROMOTIVE FURNITURE DRIVE ASSEMBLY

CROSS-REFERENCES TO RELATED APPLICATIONS

This application is the U.S. National Stage of International Application No. PCT/EP2013/062364, filed Jun. 14, 2013, which designated the United States and has been published as International Publication No. WO 2013/186356 and which claims the priority of German Patent Application, Ser. No. 10 2012 105 227.1, filed Jun. 15, 2012, pursuant to 35 U.S.C. 119(a)-(d).

BACKGROUND OF THE INVENTION

The invention relates to an electromotive furniture drive assembly and an assembly of such an electromotive furniture drive assembly in a piece of furniture.

Electromotive furniture drive assemblies are known in numerous different arrangements for furniture. This furniture is also known as adjustable furniture such as beds, TV chairs, tables and the like. The operation of such a furniture drive assembly occurs by manual control units, which are also known as manual switches and are arranged either in a wire-bound or wireless manner (infrared, radio, ultrasonic sound). In the case of wireless furniture drive assemblies, standard radio transmission links with frequencies in the ranges of 2.4 GHz, 868 MHz, 433 MHz etc are known for example. Instead of a wire-bound manual control unit the receiver can be connected, especially in the case of retrofitting, to the furniture drive or the control unit of the furniture drive. The receiver which is connected by plugging into the furniture drive acts like a wire-bound manual switch and comprises signal switches (transistor switches or relay switches) like manual switches, which are radio-controlled and whose switching contacts are in connection with the plug-in connection of the furniture drive or the control unit. In this case, it is also possible to use other types of radio transmission such as Bluetooth, wireless LAN etc as a result of the selection of the receiver configuration, wherein mobile phones, PCs etc can also be used as control units.

In other cases, the receiver is installed in the furniture drive, wherein the furniture drive or its control unit no longer comprises any connections for wire-bound manual control units anymore, but only operates with standard radio hand-held transmitters.

In view of currently increasing versatility of the possibilities to use mobile phones and multimedia devices, there is a demand for furniture drive assemblies which offer improved operational control features.

SUMMARY OF THE INVENTION

It is therefore the object of the present invention to provide an improved electromotive furniture drive assembly.

It is a further object of the present invention to provide an assembly with a respective drive assembly with a piece of furniture.

According to one aspect of the invention, the object is achieved by an electromotive furniture drive assembly which includes at least one electromotive furniture drive, at least one drive control device with a receiving device for wireless radio transmission, at least one communication device for operating the furniture drive, and at least one communication adaptation device, which is arranged for communication with the at least one communication device via a wireless primary transmission link and for communication with the at least one receiving device via a wireless secondary transmission link.

According to another aspect of the invention, the object is achieved by an assembly including at least one piece of furniture and an electromotive furniture drive assembly as set forth above.

The electromotive furniture drive assembly is provided with a communication adaptation device which produces communication with a communication device and a receiving device of an electromotive furniture drive with a conventional standard radio transmission link.

This offers the advantage that simple and conventional furniture drives with standard radio remote control can be operated in a versatile manner by the communication adaptation device with different radio remote controls, especially communication devices such as mobile phones for example.

An electromotive furniture drive assembly comprises at least one electromotive furniture drive, at least one drive control device with a receiving device for wireless radio transmission, and at least one communication device for operating the furniture drive. At least one communication adaptation device is provided which is arranged for communication with the at least one communication device via at least one wireless primary transmission link and for communication with the at least one receiving device via a wireless secondary transmission link.

It is thus advantageously ensured that the furniture drives need not be equipped or retrofitted with a respective different receiving module for the operational control via a smart phone, mobile phone, laptop and the like, but are provided instead with a versatile improved possibility for operation only by the communication adaptation device.

There is the additional advantage that furniture drives with integrated receiving devices without connection for a wire-bound additional receiving adapter can also be retrofitted to offer the flexible possibilities for operation without intervention in the drive itself.

Additional costs for such adapters can be avoided. Retrofitting costs by changing the furniture drives are also avoided. Retrofitting is possible at any time without changing the furniture drive.

Further features and advantages of the operator control unit are the subject matter of the relevant sub-claims.

It is provided that the wireless primary transmission link is arranged differently from the wireless secondary transmission link. As a result, the primary transmission link can be arranged as a Bluetooth, ZigBee and/or wireless LAN transmission link, wherein the secondary transmission link is a standard radio transmission link.

It is understood that other types of radio transmission are possible. Any furniture drive with a radio interface can be used.

The secondary transmission link is arranged as a standard radio transmission link, but not as a Bluetooth, ZigBee or/and wireless LAN transmission link.

The standard radio link arranged as a secondary transmission link comprises such radio signals which are provided in the production of the furniture drive and are transmitted in the operation with a manual radio transmitter for furniture drives. Said standard radio transmission link is a radio transmission link that has been specifically developed for furniture drives and is arranged in the simplest possible way with the lowest number of commands, wherein the low-price sector, in which these furniture drives are found, relevantly determines the simplicity of the standard radio transmission link.

In a further embodiment, the primary transmission link and the secondary transmission link are bidirectional radio transmission links. It is an advantage that the communication adaptation device thus can also transmit data of the furniture drive (e.g. data on wear and tear, time of operation, overloading etc, or feedback on the status and information on switching states of lamps, massages, heating units etc which are operated by or with the furniture drive) to the communication device for display and further transmission to higher-level evaluation units.

An alternative electromotive furniture drive assembly comprises at least one electromotive furniture drive, at least one drive control device with a receiving device for wireless infrared transmission, and at least one communication device for operating the furniture drive. The electromotive furniture drive assembly further comprises at least one communication adaptation device, which is arranged for communication with the at least one communication device via a wireless primary transmission link and for communication with the at least one receiving device via a wireless secondary transmission link.

This alternative embodiment allows advantageously expanding the scope of application of the invention considerably, in that electromotive drives with wireless infrared control by means of the communication adaptation device can also be operated by means of a communication device.

In one embodiment, the wireless primary transmission link is different from the wireless secondary transmission link in the form of different frequencies, modulation methods, command sets and/or transmission protocols. This further increases the scope of application.

This advantage is improved even further if the primary transmission link is arranged as a Bluetooth, ZigBee and/or wireless LAN transmission link, wherein the secondary transmission link can be a standard infrared transmission link for controlling a furniture drive.

Alternatively, the secondary transmission link can be arranged as a Bluetooth, ZigBee and/or wireless LAN transmission link if the initially described standard radio transmission link is provided for the primary transmission link. The scope of application of the communication adaptation device thus increases advantageously because a known, standardized radio remote control unit can be used for controlling the electromotive furniture drive if the receiving device of the furniture drive is only arranged for receiving signals of a Bluetooth, ZigBee and/or wireless LAN transmission link.

Alternatively, both the primary transmission link and also the secondary transmission link can comprise similar signals such as Bluetooth, ZigBee, standard radio signals and/or wireless LAN signals, which advantageously increase the scope of application of the communication adaptation device because an adaptation in the frequency and/or signal and/or transmission protocol of the different radio signals can be provided.

It is provided in a further embodiment that the primary transmission link and the secondary transmission link are bidirectional transmission links. This makes operation with the communication device especially convenient, because acknowledgements are enabled so that control of different executions of commands is simplified.

It is provided in yet a further embodiment that the at least one communication adaptation device is provided with a primary communication unit for communication with the at least one communication device and with a secondary communication unit for communication with the at least one receiving device. Simple connection with the different transmission links can thus be enabled.

It is further provided that the at least one communication adaptation device is provided with an adaptation unit for adapting the communication device to the at least one receiving device of the electromotive furniture drive by producing communication between the communication device and the at least one receiving device of the electromotive furniture drive. This ensures simple adaptation.

It is also possible that several furniture drives are triggered by only one communication adaptation device and/or only one communication device.

Differences in the transmission frequency, the command words, the data records, the transmission speed etc are considered in this case as adaptations.

In another embodiment, the at least one communication adaptation device is arranged in such a way that it recognizes the communication device automatically and/or in a manner that can be preset. Automatic recognition can occur by respective data which is stored in a memory unit of the communication adaptation device. A presetting with respect to the type of transmission or the type of radio of the communication device or receiving device of the furniture drive to the communication adaptation device can be made in a simple manual fashion by means of a control switch.

In yet a further embodiment, the at least one communication adaptation device is arranged as a pluggable device in a separate housing with a mains connection. As a result, the communication adaptation device is exchangeable when other radio standards are used. Intervention in the furniture drive is not necessary. The pluggable communication adaptation device can be accessed rapidly and easily for an update. The update is conducted via the primary transmission link in one embodiment. In another embodiment, the update is conducted via the secondary transmission link. In a further embodiment, the communication adaptation device comprises a plug connector with plug contacts, wherein the communication adaptation device can be coupled to a programming device in an electrically conductive or wireless manner. The programming device can be arranged as a PC or as a laptop, or alternatively as a memory module such as a USB stick or flashcard.

In an alternative embodiment, the at least one communication adaptation device is arranged in a separate housing and comprises at least one power supply connection for low voltage and/or a separate power supply unit as a battery or a rechargeable battery or as a photovoltaic cell. This allows operation that is independent of the mains.

In yet a further embodiment, the at least one communication adaptation device is arranged in a separate housing and comprises at least one connection for the power supply of an additional device. Such an additional device can be a data storage unit in which data are stored which are transmitted by the furniture drive.

It can further be possible in a further embodiment that the electromotive furniture drive assembly further comprises an additional standard radio remote control unit. Operation can thus be carried out for example when the communication device is used for other purposes such as phoning for example.

This advantage can also be provided in the alternative embodiment when the electromotive furniture drive assembly further comprises an additional standard infrared remote control unit.

It is provided in yet a further embodiment that the at least one communication adaptation device comprises at least one signaling device for signaling its transmission properties. It can thus be recognized rapidly during a new installation or a change in the position when ranges are no longer maintained for example. Rapid remedy of the situation can occur in this case because such range errors are signaled without delay.

An assembly comprises at least one piece of furniture and the aforementioned electromotive furniture drive assembly.

The present invention thus provides an electromotive furniture drive assembly with a communication adaptation device which as a kind of "converter" or "translator" produces communication adaptation between the communication device (Bluetooth, wireless LAN) and not only a standard radio furniture drive but also a standard infrared furniture drive such as with an RC5 protocol.

The following advantages are provided:

Every single drive with a radio interface or infrared control is compatible with the communication adaptation device.

No special firmware or software level of the drive or the control unit is necessary because the communication adaptation device simulates or forms a manual radio transmitter or a manual infrared transmitter.

The drives or control units need not supply the communication adaptation device with power because the communication adaptation device has its separate power supply unit. This is a major advantage with respect to the high power drain of current Bluetooth and wireless LAN components because the provision of power in the drive need not be additionally increased.

The communication adaptation device can be positioned outside of the associated piece of furniture and is thus easily accessible for wireless LAN configuration for example, and it can easily be exchanged and can easily be retrofitted.

For the purpose of adaptation to future radio standards in wireless networks for example, the communication adaptation device can be exchanged easily without requiring any intervention in the furniture drive or drives.

BRIEF DESCRIPTION OF THE DRAWING

The invention is now explained in closer detail by reference to embodiments shown in the drawings, wherein.

DETAILED DESCRIPTION OF PREFERRED EMBODIMENTS

Figure 1:
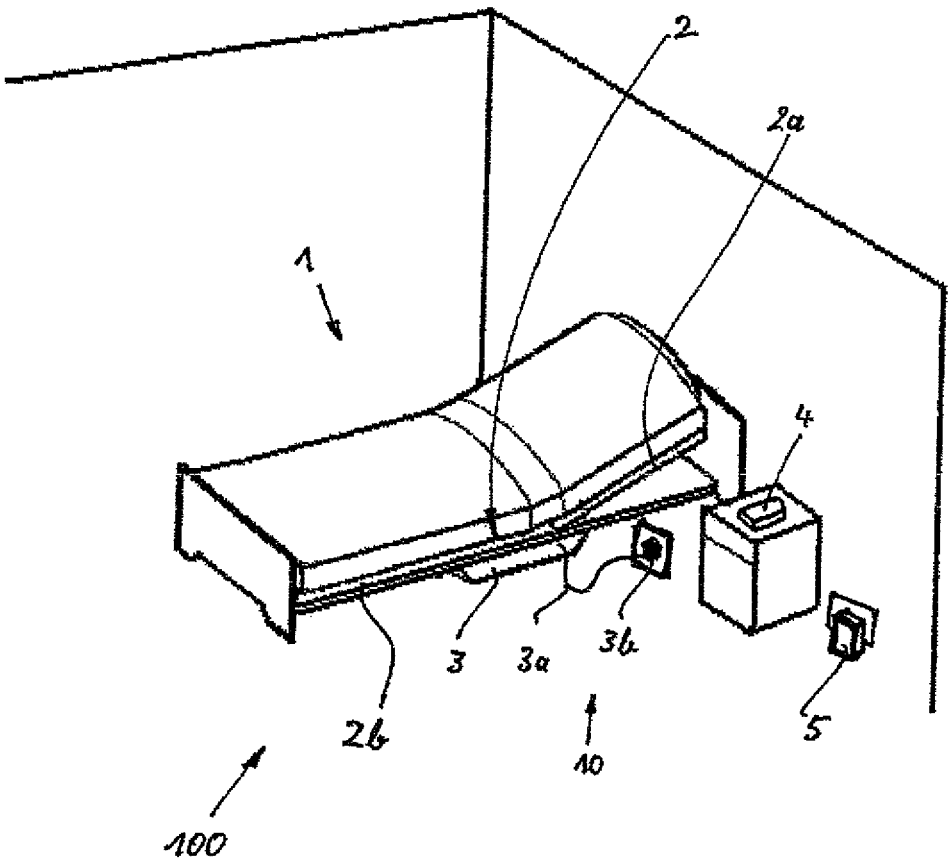
FIG. 1 shows a schematic perspective view of an embodiment of an assembly with a furniture drive assembly in accordance with the invention and an exemplary piece of furniture.

The same or similar functional units are, shown in the drawings with the same reference numerals.

FIG. 1 shows a schematic perspective view of an embodiment of an assembly 100 with a furniture drive assembly 10 in accordance with the invention and with an exemplary piece of furniture 1.

The assembly 100 comprises a piece of furniture 1 with the furniture drive assembly 10. The piece of furniture is a bed with a slatted frame 2 in this embodiment, on which a mattress is disposed that is not designated in closer detail. The slatted frame 2 comprises in this case an adjustable head part 2*a* and an adjustable foot/leg part 2*b*. A furniture drive 3 is attached beneath the slatted frame 2, which drive cooperates with the adjustable parts of a slatted frame 2. The illustration shows the head part 2*a* which is adjusted by the electromotive furniture drive 3. The furniture drive 3 is arranged in this embodiment as a so-called double drive. It is understood that individual drives in different numbers can also be used as a furniture drive 3 and can also be used in combination with a double drive.

The furniture drive 3 is explained below in closer detail. It is connected by means of a connecting line 3*a* and a connecting plug 3*b* to the electrical power supply network via an outlet not designated in closer detail.

The furniture drive assembly 10 comprises the electromotive furniture drive 3, a communication device 4 and a communication adaptation device 5.

A nightstand, which is also not designated in closer detail, is situated adjacent to the bed, on which the communication device 4 is situated for operating the electromotive furniture drive 3 according to the illustrated situation according to FIG. 1. The communication device 4 is a mobile phone for example, a so-called smart phone, a personal computer, a laptop or any other multimedia device with operating properties.

The communication device 4 communicates via the communication adaptation device 5 with the electromotive furniture drive 3 via wireless transmission link by means of radio transmission. The communication adaptation device 5 is provided in this case with power supply from the power supply network and inserted into a further power outlet.

The communication adaptation device 5 communicates with the communication device 4 in the manner of the communication device 4 via Bluetooth, wireless LAN, radio, ZigBee, radio with individual transmission protocols or the like. Furthermore, the communication adaptation device 5 communicates with a control unit of the electromotive furniture drive in the manner of the control unit and thus in the manner of a standard manual radio switch for furniture drives. The communication adaptation device 5 is thus capable of communicating the control signals of the communication device 4 to the control unit of the electromotive furniture drive 3 in such a way that it is controllable by the communication device 4. In other words, the communication adaptation device 5 translates the signals of the communication device 5 from the "language" of the communication device 5 to the "language" of the control unit of the electromotive furniture drive 3. An apparatus is thus provided according to inventive step in the simplest possible way by the communication adaptation device 5, as a result of which a large number of different communication devices 4 can be coupled to a conventional furniture drive 3 by means of control technology.

This is described below in closer detail by reference to FIG. 2.

Figure 2:
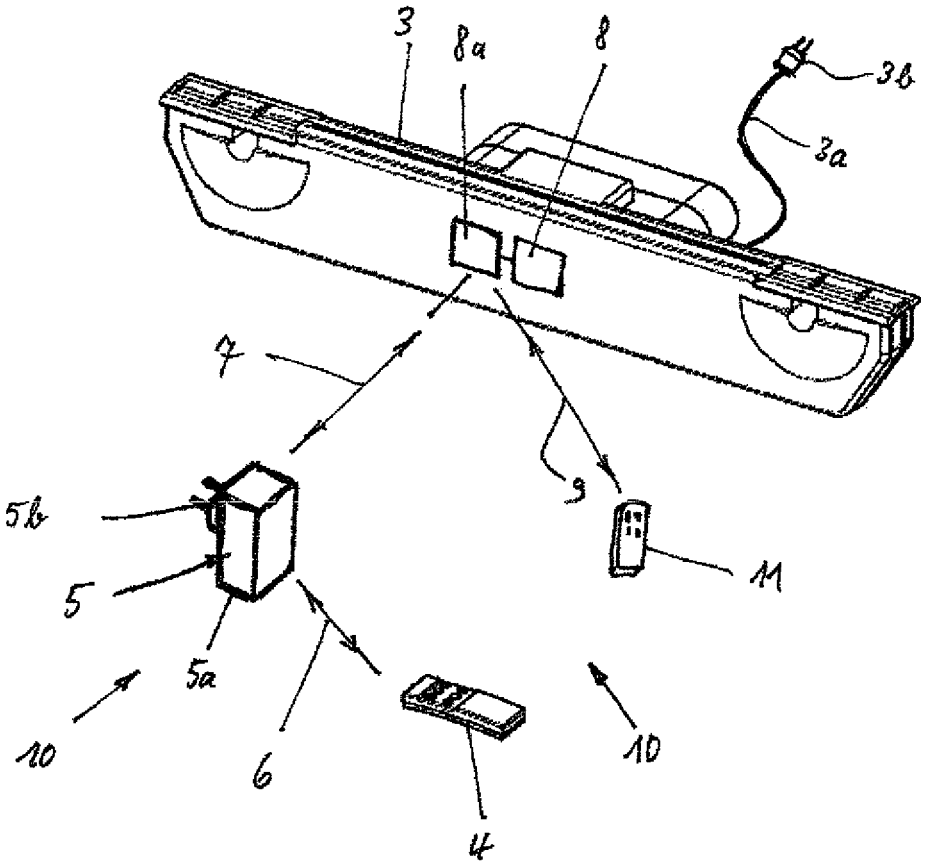
FIG. 2 shows a schematic perspective view of an embodiment of the furniture drive assembly in accordance with the invention.

FIG. 2 represents a schematic perspective view of an embodiment of the furniture drive assembly 10 in accordance with the invention.

The electromotive furniture drive 3 is arranged as a conventional double drive and comprises a drive control device 8 with a receiving device 8*a*. The receiving device 8*a* is configured for conventional radio transmission via a bidirectional radio transmission link 9 with an associated radio remote control unit 11. The radio remote control unit 11 is not a component of the furniture drive assembly 10 in this embodiment, but is only shown for reasons of explanation. The bidirectionality of the radio transmission link 9 is indicated by two arrows facing in opposite directions.

The furniture drive assembly 10 comprises the communication adaptation device 5 for using the communication device 4.

In this embodiment, the communication adaptation device 5 automatically recognizes the communication device 4 by wireless communication. The communication adaptation device 5 communicates for this purpose with the communication device 4 via a wireless bidirectional primary transmission link 6 in the manner of radio transmission which is predetermined by the communication device 4. The Bluetooth type of communication can thus be set in a mobile phone for example.

After recognizing the communication device 4, the communication adaptation device 5 is ready for receiving radio signals of the communication device 4 for controlling the electromotive furniture drive 3. These control signals can be the activation and deactivation signals for a drive motor of the furniture drive 3 for the head part 2*a* of the slatted frame 2 of the piece of furniture 1 in FIG. 1 for moving up the head part 2*a*.

The signals thus received are "translated" by the communication adaptation device 5 in the manner of radio transmission of the conventional radio transmission link 9 and transmitted by a bidirectional secondary transmission link 7 in a wireless manner to the receiving device 8*a* of the electromotive furniture drive 3. In other words, the secondary transmission link 7 has the properties of the conventional radio transmission link 9.

The signals of the communication device 4 thus "translated" by the communication adaptation device 5 are received by the receiving device 8*a* and relayed as control signals to the drive control unit 8 of the furniture drive 3 for the respective adjustment of the desired drive.

In this embodiment, the communication adaptation device 5 comprises a housing 5*a* with a mains connection 5*b*. The mains connection 5*b* is arranged as a national mains plug and is produced integrally with the housing 5*a* for example. In one variant the mains connection 5*b* can also be an insert part or an exchangeable insert part which corresponds to the respective national plug configuration. The communication adaptation device 5 can thus be inserted directly into a power outlet and is provided with power supply from the mains which is necessary in the communication adaptation device 5 for operation of the relevant functional units. These functional units will be described below in closer detail.

Figure 3:
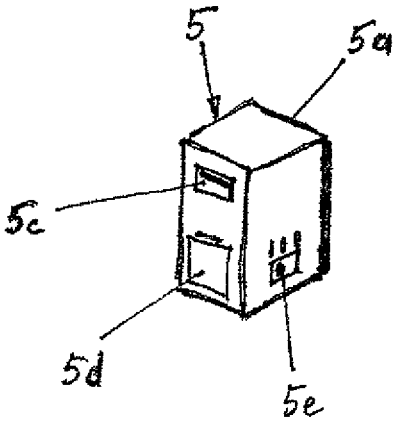
FIG. 3 shows a schematic perspective view of a variant of a communication adaptation device.

FIG. 3 shows a schematic perspective view of a variant of the communication adaptation device 5.

In this variant, the communication adaptation device 5 comprises a housing 5*a* without a mains connection 5*b*. Instead, it comprises a power supply connection 5*c* for low voltage, e.g. a USB connector. The communication adaptation device 5 can be operated for example via said power supply connection 5*c* through a USB cable for example with power supply from the communication device 4, from a separate power unit or from the furniture drive 3 (in so far as it comprises a respective connection).

It is further possible that the communication adaptation device 5 has a separate power supply unit 5*d* which provides a battery or a rechargeable battery which is accommodated in a respective compartment in the housing 5*a*.

The variant according to FIG. 3 further shows a potential selector switch 5*e*, with which the type of communication can be selected for the primary transmission link 6 instead of an automatic selection.

Figure 4:
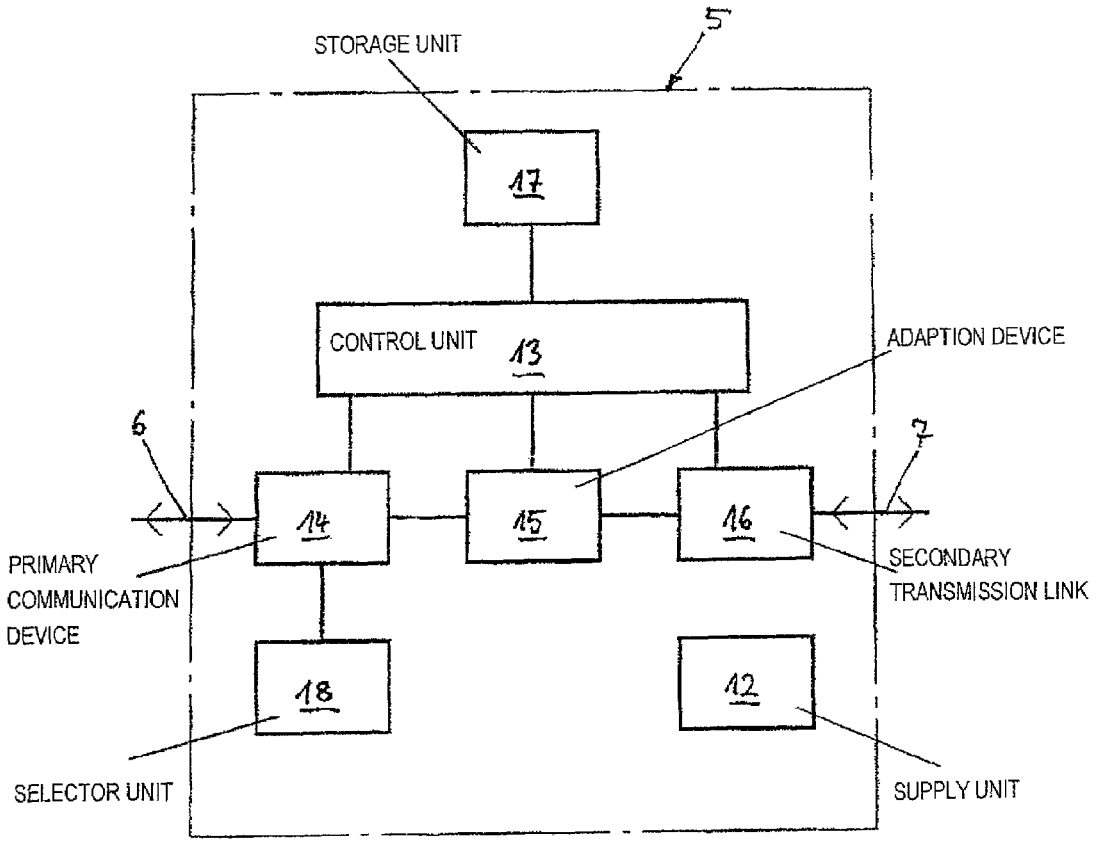
FIG. 4 shows a schematic block diagram of the communication adaptation device.

Finally, FIG. 4 shows a schematic block diagram of the communication adaptation device 5.

The communication adaptation device 5 comprises a supply unit 12, a control unit 13, a primary communication unit 14, an adaptation unit 15, a secondary communication unit 16, a selector unit 18 and a storage unit 17.

The supply unit 12 provides the supply voltage for the functional units of the communication adaptation device 5 either from mains voltage (mains connection 5*b*), from the power supply connection 5*c* or from its own power supply unit 5*d*.

The control unit 13 is used for controlling the primary communication unit 14, the adaptation unit 15, the secondary communication unit 16, the selector unit 18 and the storage unit 17 with which it is connected.

The primary communication device 14 communicates with the communication device 4 via the bidirectional primary transmission link 6, wherein the communication device 4 is recognized either automatically or by the selector unit 18 which is adjustable by the selector switch 5*e*. The bidirectional primary transmission link 6 is used both for transmitting signals from the communication device 4 to the primary communication unit 14 and also vice versa.

A "translation" of the signals transmitted by the communication device 4 occurs by means of the adaptation unit 15, which signals are relayed from the primary communication unit 14 to the adaptation unit 15.

The adaptation unit 15 generates signals therefrom which it then transmits via the secondary transmission link 16 to the receiving device 8*a* of the furniture drive 3. Communication also occurs in this case in a bidirectional manner via the secondary transmission link 7 between the secondary transmission link 7 and the receiving device 8*a*.

The storage unit 17 is connected in this case to the control device 13. Program data for the operation of the communication adaptation device 5 is stored in the storage unit 17 for example. Furthermore, the storage unit 17 contains data which are required by the adaptation unit 15 for the "translation" (i.e. adaptation) and for the communication units 14 and 16 for recognizing the communication partners (communication device 4 and receiving device 8*a*). The storage unit 17 can also be used for storing temporary data and other data.

The communication adaptation device 5 represents an adaptation between the communication device 4 (e.g. communication type Bluetooth or wireless LAN) and the standard radio receiving device 8*a* of the furniture drive 3.

The invention is not limited to the aforementioned embodiments, but can be modified within the scope of the enclosed claims.

As a result, the communication adaptation device 5 can also comprise an additional connection (e.g. USB) for the connection of further additional devices such as memories or for charging smartphones and the like.

It can be considered for example that the communication adaptation device 5 comprises a so-called mains isolation switch, via which the power supply of the electromotive furniture drive 3 can be activated and deactivated. The connecting line 3*a* of the furniture drive 3 can be connected either directly to the mains isolation switch or the connecting plug 3*b* in a power outlet which is arranged in the communication adaptation device 5 and is switched by the mains isolation switch: In one embodiment, the mains voltage of this power outlet can be switched by a controlled switch such as a controlled relay switch and is part of the mains isolation switch. During non-use of the furniture drive 3, at least one switching contact of the controlled relay switch is open, so that the supply voltage of the furniture drive 3 is not provided during non-use. The control unit 13 generates a switching command for activating the control switch or the controlled relay switch which only when the primary transmission link 6 and/or the secondary transmission link 7 has been supplied with radio command signals of the communication device 4 or the radio remote control unit 11.

Furthermore, the communication adaptation device 5 can comprise a power outlet which is directly or switchably connected (e.g. switchable by the communication device 4) to the mains connection 5*b* of the communication adaptation device 5.

Such an additional power outlet can be used for a nightstand lamp for example, which can be switched either by a separate switch and/or via the communication device 4.

Furthermore, the communication adaption device 5 can be provided with the glow light such as an LED, which is switchable either directly on the communication adaptation device 5, indirectly by the communication device 4 with signal passage via the primary transmission link 6, the secondary transmission link 7 into the furniture drive 3 (for activating/deactivating a further glow light situated in the furniture drive 3) and back via the secondary transmission link 7 to the glow light of the communication adaptation device 5, or via the communication device 4 with signal passage via the primary transmission link 6 to the glow light in the communication adaptation device 5.

Furthermore, the communication adaptation device 5 can comprise a motion detector for switching the glow light and/or the power outlet or other functions. Moreover, a light sensor can be assigned to the control circuit of the glow light.

It can be considered in another embodiment that the housing 5*a* of the communication adaptation device 5 is arranged as a multiple outlet strip.

The drive control device 8 and/or the receiving device 8*a* can also be arranged as a separate apparatus or separate apparatuses.

Data of the electromotive furniture drive (3) (e.g. overloading, activation period etc) can also be transmitted by the communication adaptation device 5 to the communication device 4 by means of the bidirectional transmission links 6, 7. It can also be possible that these data are reported visually, acoustically or haptically by the communication device 4.

Furthermore, the data thus transmitted by the communication device 4 can be relayed to other transmission links (e.g. wireless LAN, digital networks etc) to higher-level locations for monitoring, evaluation etc for example.

Furthermore, a simple procedure for the adaptation of the communication adaptation device 5 to other transmission links 6, 7 is provided, which transmission links do not yet exist at the time of production of the communication adaptation device 5. If the communication adaptation device 5 comprises a data connection, the procedure of programming adaptation occurs via said connection in a wire-bound manner. This occurs in the simplest manner however via one of the transmission links 6, 7. A pushbutton can be provided as an alternative, wherein the initialization occurs in the known manner upon actuation of said button.

The additional power outlet can also be arranged in a switchable and/or dimmable manner by the furniture drive 3 or the communication device 4. Respective load switches (e.g. relays, semiconductors, electronic dimmers) of the additional power outlet can be connected in series.

It is obviously also possible that this power outlet or a further additional power outlet is provided which continuously carries mains voltage when the communication adaptation device 5 is inserted as a pluggable device into an already existing power outlet, wherein the additional power outlet is then used as a replacement for the power outlet used by the communication adaptation device 5.

Connections can further be provided on the communication adaptation device 5, which connections conduct a switching signal for further plug-in connections and/or power outlets and/or consumers. The communication adaptation device 5 comprises at least one, plug-in connection which can be connected to a plug-in connection of a further control unit (e.g. control box) (either via a cable or directly in that said further control unit can be plugged into the communication adaptation device 5).

The additional connection for the connection of further additional devices can be arranged as such or as a further connection as a voltage output, via which small devices can be supplied with low voltage. Such supply can be used for example for charging a rechargeable battery of the respective small device. The additional connection can be arranged as a USB connection for example. The small device can be a mobile phone for example (smartphone or the like) and/or a playback device for media (e.g. MP3 player).

The power supply connection 5*c* can be arranged as the additional connection for example. Furthermore, it can obviously also be arranged in a switchable manner.

The communication adaptation device 5 can also be provided or arranged in a housing of a charging cradle for charging a phone or the like instead of an arrangement as a plug-in part. It is further also possible that the communication adaptation device 5 is integrated in a housing of a clock (alarm clock, radio alarm clock) or a table lamp (or vice versa). This means that the communication adaptation device 5 is introduced into such a housing which is usually arranged next to or adjacent to a piece of furniture 1 with the electromotive furniture drive 3 such as on a nightstand adjacent to a bed.

It is further possible that the secondary transmission link 7 is an optical transmission link such as an infrared transmission link. In this case, the receiving device 8*a* of the electromotive furniture drive 3 is arranged for receiving optical transmission signals of an infrared remote control unit (not shown, but identical to the radio remote control unit 11 shown in FIG. 2) via an infrared transmission link (also not shown, but identical to the radio transmission link 9 shown in FIG. 2). In this case, the secondary communication unit 16 of the communication adaptation device 5 is arranged for communication with the optical receiving device 8*a* of the electromotive furniture drive 3 according to the transmission of (and also bidirectionally for receiving) optical signals (infrared signals in this case). In this process, the signals of the communication device 4 are "translated" by the communication adaptation device 5 in the manner of infrared transmission of the usual infrared transmission link and transmitted by the bidirectional secondary transmission link 7 which is arranged as an optical infrared transmission link' in a wireless manner to the receiving device 8*a* of the electromotive furniture drive 3. In other words, the secondary transmission link 7 has the properties of the usual infrared transmission link in this case. The signals of the communication device 4 which are thus "translated" by the communication adaptation device 5 are received by the receiving device 8*a* and relayed as control signals to the drive control device 8 of the furniture drive 3 for the respective adjustment of the desired drive.

If the primary transmission link 6 and the secondary transmission link 7 are operated within a frequency, both transmission link 6 and 7 can be operated by means of one antenna arrangement. Alternatively, each transmission link comprises its own antenna and its own transmitter, which is arranged for the respective "transmission waves", e.g. a 2.4 GHz antenna or a so-called F-antenna (both for radio transmission), or suitable transmission and receiving elements for optical transmission (infrared transmission/receiving elements).

It can further be considered that all transmission possibilities (radio, optics) are provided in the communication adaptation device 5 in one embodiment and are respectively adjustable (also automatically adjustable).

The storage unit 17, which is also used for storing temporary data and other data, can also be arranged as an intermediate storage unit. The control commands which are sent by the communication device 4 via the primary transmission link 6 to the communication adaptation device 5 can be stored in an intermediate fashion in the storage unit 17 and/or in a part of the storage unit 17 which is provided for this purpose. After processing/translating said intermediately stored commands, the commands thus processed/translated can be intermediately stored in a further storage unit, from which they are then read out by the secondary communication unit 16 and are transmitted via the secondary transmission link 7.

The storage unit 17 can also comprise a read-only memory, which is an EEPROM for example. Addresses and/or frequencies of the communication device 4 and also the target (furniture drive 3, drive control device 8, operating units, control unit 13 and the like) are stored there in order to address the commands in a suitable fashion.

It is further possible to provide one or several signaling devices (optical, acoustic or in combination) in the communication adaptation device 5 for signaling transmission properties (e.g. communication with transmitter/receiver), which are arranged in the field of vision and/or in the auditory range of an operator. Such signaling devices such as one or two LEDs inform the user that the communication adaptation device 5 is in communication with the communication device 4 and/or the furniture drive 3 and receives and transmits data. Such a notification not only informs the operator that he or she is within the range of the communication adaptation device 5 with the respective communication device 4, but that the communication adaptation device 5 also communicates with the furniture drive 3. If the latter is not the case the operator can intervene (e.g. during the installation or after the change in the positions of the communication adaptation device 5 and the furniture drive 3) and adjust the distance between the communication adaptation device 5 and the furniture drive 3 for functional communication. This can also be advantageous in the case of an infrared transmission path for example. The signaling device can also be a two-color LED which signalizes different notifications by blinking signals, permanent light and/or color of the light.

What is claimed:

1. An electromotive furniture drive assembly, comprising:

at least one electromotive furniture drive;

at least one drive control device having at least one receiving device configured for wireless transmission;

at least one communication device for operating the furniture drive; and at least one communication adaptation device configured to communicate with the at least one communication device via a wireless primary transmission link and to communicate with the at least one receiving device via a wireless secondary transmission link, wherein the wireless primary transmission link is configured different from the wireless secondary transmission link, with the wireless primary transmission link and the wireless secondary transmission link having different frequencies, different modulation methods, different command sets and/or different transmission protocols.

2. The electromotive furniture drive assembly of claim 1, wherein the at least one receiving device is configured for wireless radio transmission.

3. The electromotive furniture drive assembly of claim 2, wherein the primary transmission link is configured as a Bluetooth, ZigBee and/or wireless LAN transmission link, and the secondary transmission link is configured as a standard radio transmission link for controlling the furniture drive.

4. The electromotive furniture drive assembly of claim 2, wherein the primary transmission link and the secondary transmission link are bidirectional radio transmission links.

5. The electromotive furniture drive assembly of claim 2, further comprising an additional standard radio remote control unit for communication with the at least one receiving device.

6. The electromotive furniture drive assembly of claim 1, wherein the at least one receiving device is configured for wireless infrared transmission.

7. The electromotive furniture drive assembly of claim 6, wherein the primary transmission link is configured as a Bluetooth, ZigBee and/or wireless LAN transmission link, and the secondary transmission link is configured as a standard infrared transmission link for controlling the furniture drive.

8. The electromotive furniture drive assembly of claim 6, wherein the primary transmission link and the secondary transmission link are bidirectional transmission links.

9. The electromotive furniture drive assembly of claim 6, further comprising a standard infrared remote control unit for communication with the at least one receiving device.

10. The electromotive furniture drive assembly of claim 1, wherein the at least one communication adaptation device comprises at least one signaling device for signaling transmission properties thereof.

11. An electromotive furniture drive assembly, comprising:

at least one electromotive furniture drive;

at least one drive control device having at least one receiving device configured for wireless transmission;

at least one communication device for operating the furniture drive; and at least one communication adaptation device configured to communicate with the at least one communication device via a wireless primary transmission link and to communicate with the at least one receiving device via a wireless secondary transmission link, wherein the at least one communication adaptation device includes a primary communication unit configured to communicate with the at least one communication device, and a secondary communication unit configured to communicate with the at least one receiving device.

12. The electromotive furniture drive assembly of claim 11, wherein the at least one communication adaptation device includes an adaptation unit configured to adapt the at least one communication device to the at least one receiving device of the electromotive furniture drive by establishing a communication between the at least one communication device and the at least one receiving device of the electromotive furniture drive.

13. An electromotive furniture drive assembly, comprising:

at least one electromotive furniture drive;

at least one drive control device having at least one receiving device configured for wireless transmission;

at least one communication device for operating the furniture drive; and at least one communication adaptation device configured to communicate with the at least one communication device via a wireless primary transmission link and to communicate with the at least one receiving device via a wireless secondary transmission link, wherein the at least one communication adaptation device is configured to recognize the at least one communication device in an automatic and/or pre-adjustable manner.

14. An electromotive furniture drive assembly, comprising:

at least one electromotive furniture drive;

at least one drive control device having at least one receiving device configured for wireless transmission;

at least one communication device for operating the furniture drive; and at least one communication adaptation device configured to communicate with the at least one communication device via a wireless primary transmission link and to communicate with the at least one receiving device via a wireless secondary transmission link, wherein the at least one communication adaptation device is configured as a pluggable device having a housing with a mains connection.

15. An electromotive furniture drive assembly, comprising:

at least one electromotive furniture drive;

at least one drive control device having at least one receiving device configured for wireless transmission;

at least one communication device for operating the furniture drive; and at least one communication adaptation device configured to communicate with the at least one communication device via a wireless primary transmission link and to communicate with the at least one receiving device via a wireless secondary transmission link, wherein the at least one communication adaptation device has a housing and at least one power supply connection on a side of the housing for low voltage and/or a separate power supply as a battery or a rechargeable battery.

16. An electromotive furniture drive assembly, comprising:

at least one electromotive furniture drive:

at least one drive control device having at least one receiving device configured for wireless transmission;

at least one communication device for operating the furniture drive: and at least one communication adaptation device configured to communicate with the at least one communication device via a wireless primary transmission link and to communicate with the at least one receiving device via a wireless secondary transmission link, wherein the at least one communication adaptation device has a housing and at least one connection on a side of the housing for power supply of an additional device selected from the group consisting of a data memory, and a rechargeable battery of a mobile phone or a multimedia device.

* * * * *